US010865021B2

(12) United States Patent
Suzuki et al.

(10) Patent No.: US 10,865,021 B2
(45) Date of Patent: Dec. 15, 2020

(54) ONE-TOUCH OPENABLE CAP

(71) Applicant: GC Corporation, Shizuoka (JP)

(72) Inventors: Takumi Suzuki, Tokyo (JP); Akihiro Fujii, Inashiki-gun (JP)

(73) Assignee: GC CORPORATION, Tokyo (JP)

( * ) Notice: Subject to any disclaimer, the term of this patent is extended or adjusted under 35 U.S.C. 154(b) by 0 days.

(21) Appl. No.: 16/534,279

(22) Filed: Aug. 7, 2019

(65) Prior Publication Data

US 2019/0359394 A1 Nov. 28, 2019

Related U.S. Application Data

(63) Continuation of application No. PCT/JP2017/039182, filed on Oct. 30, 2017.

(30) Foreign Application Priority Data

Feb. 8, 2017 (JP) ..... 2017-021364

(51) Int. Cl.
*B65D 47/08* (2006.01)
*B65D 47/18* (2006.01)

(52) U.S. Cl.
CPC ..... *B65D 47/0885* (2013.01); *B65D 47/18* (2013.01)

(58) Field of Classification Search
CPC ..... B65D 47/0885; B65D 47/18
USPC ..... 222/556, 563; 215/237, 235; 220/254.5, 220/254.7, 839
See application file for complete search history.

(56) References Cited

U.S. PATENT DOCUMENTS 4,790,442 A * 12/1988 Gach ..... B65D 47/0885 215/216
5,328,058 A * 7/1994 Leoncavallo ..... B65D 47/0885 215/216
7,451,896 B2 * 11/2008 Robinson ..... B65D 47/0804 215/211

(Continued)

FOREIGN PATENT DOCUMENTS

JP 59-159544 U 10/1984
JP 2013-510051 A 3/2013

(Continued)

OTHER PUBLICATIONS

International Search Report dated Jan. 16, 2018, issued in counterpart International Application No. PCT/JP2017/039182, with English translation (5 pages).

*Primary Examiner* — Patrick M. Buechner
*Assistant Examiner* — Michael J. Melaragno
(74) *Attorney, Agent, or Firm* — Westerman, Hattori, Daniels & Adrian, LLP

(57) ABSTRACT

A one-touch openable cap includes: a base including coupling means coupled to a bottle, a ring connected to the coupling means and disposed with a space between the coupling means and the ring to be deformed by press forces from left and right sides so as to allow a front edge of the ring to be frontwardly pushed out, and a latch portion disposed on the front edge of the ring; and a lid portion pivotable relative to the base and including a body to cover the nozzle when the lid portion is closed, a claw disposed on the body and to be latched to the latch portion when the lid portion is closed. Upon press of the ring from the left and right sides, the ring is deformed, the claw is released from the latch portion, the lid portion pivots, and the nozzle is uncovered.

7 Claims, 7 Drawing Sheets

(56) References Cited

U.S. PATENT DOCUMENTS

| | | | | |
|---|---|---|---|---|
| 8,006,853 | B2 * | 8/2011 | Delage | B65D 47/0814 215/235 |
| 8,292,101 | B1 * | 10/2012 | Bragg | B65D 50/046 215/237 |
| 8,469,212 | B2 * | 6/2013 | Goto | B65D 47/0814 215/216 |
| 8,783,483 | B2 * | 7/2014 | Faragher | B65D 47/0838 215/224 |
| 9,102,449 | B2 * | 8/2015 | Gatton | B65D 50/041 |
| D847,659 | S * | 5/2019 | Suzuki | D9/724 |
| D859,152 | S * | 9/2019 | Suzuki | D9/447 |
| 2002/0036207 | A1 * | 3/2002 | Ohuo | B65D 47/0885 220/830 |
| 2006/0273062 | A1 * | 12/2006 | Delage | B65D 47/0814 215/237 |
| 2007/0095864 | A1 * | 5/2007 | Vangeel | B65D 47/0828 222/556 |
| 2007/0144996 | A1 * | 6/2007 | Sawyer | B65D 47/0809 215/235 |
| 2007/0205177 | A1 * | 9/2007 | Delage | B65D 47/0814 215/305 |
| 2009/0159552 | A1 * | 6/2009 | Cano-Pey | B65D 47/0828 215/235 |
| 2009/0194501 | A1 * | 8/2009 | Yamanaka | B65D 47/0814 215/235 |
| 2012/0273523 | A1 | 11/2012 | Walter et al. | |

FOREIGN PATENT DOCUMENTS

| | | | |
|---|---|---|---|
| JP | 2015-231852 | A | 12/2015 |
| JP | 2016-101953 | A | 6/2016 |

* cited by examiner

[Fig. 6]
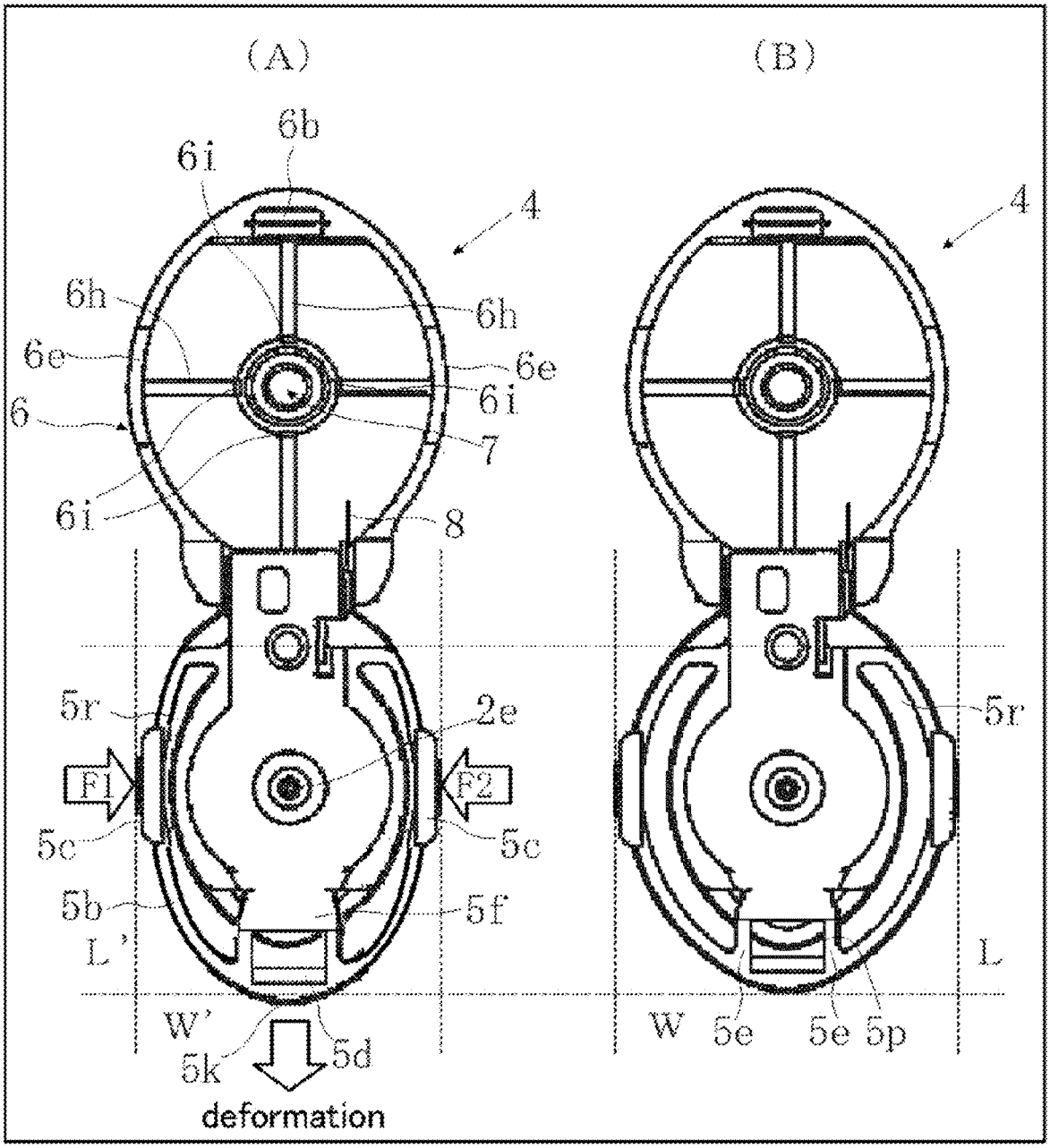

[Fig. 7]
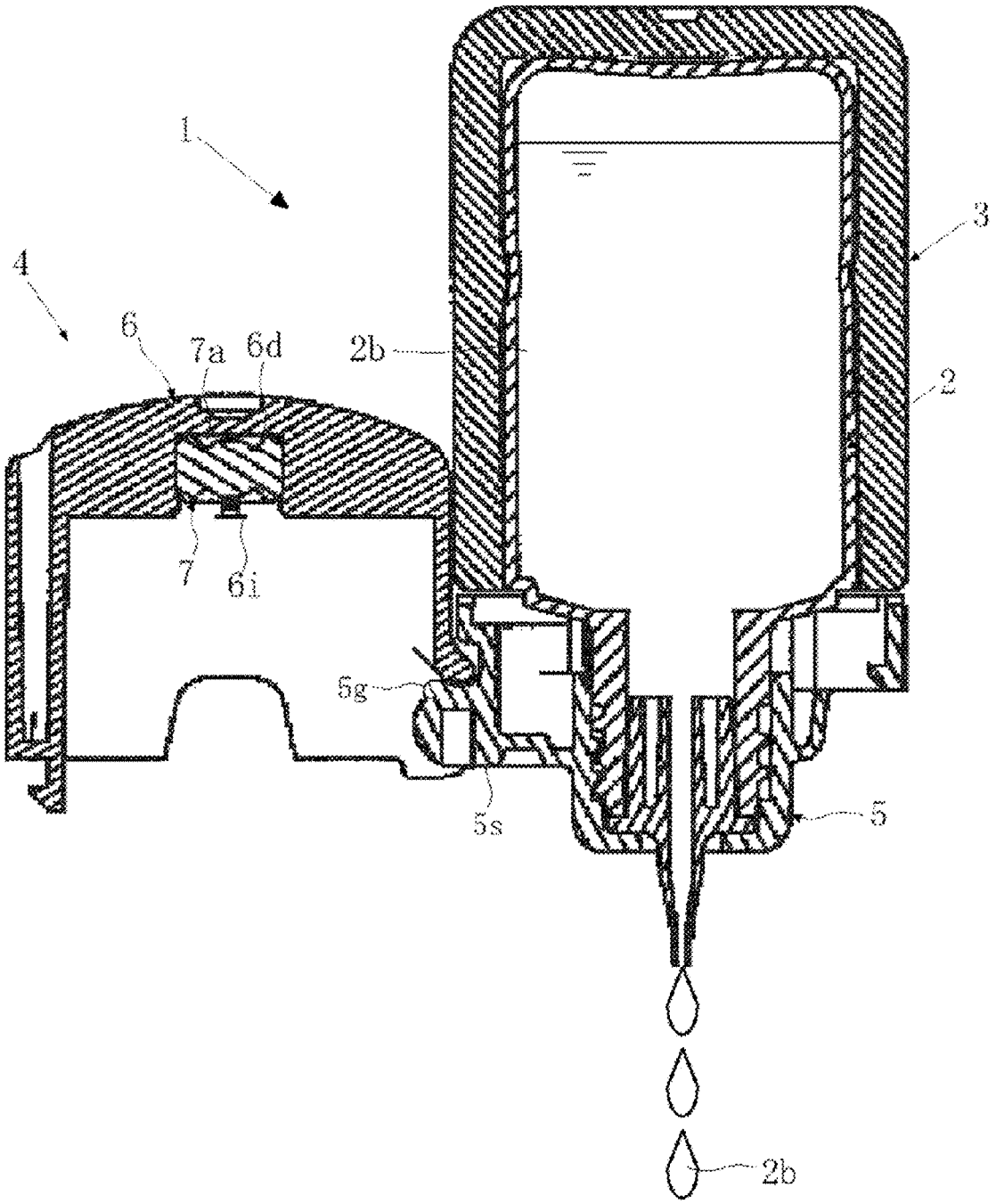

ONE-TOUCH OPENABLE CAP

CROSS-REFERENCE OF RELATED APPLICATIONS

This application is a bypass continuation of International Application No. PCT/JP2017/039182, filed Oct. 30, 2017, which claims priority of Japanese Patent Application No. 2017-021364, filed Feb. 8, 2017 in Japan, the entire contents of which are incorporated herein by reference.

TECHNICAL FIELD

The present invention relates to a one-touch openable cap that is attached to a bottle and enables an opening operation of a lid portion to be performed by a single hand, and that prevents any opening of the lid portion due to erroneous operation.

BACKGROUND ART

Examples of a cap used for a bottle and opened and closed repeatedly include a screwing type cap that allows a bottle to be opened by rotating the cap by one hand while holding the bottle by the other hand; and a fitting type cap that allows a latch portion and a claw to be latched together. Even though, however, any one of these types is employed, a both-hand operation is needed. For such a cap that needs a both-hand operation, there is a need for an interruption of another ongoing work to open the cap, and thus, its usability is not high.

Thus, caps capable of being opened by a single-hand operation have been developed. As an example of such caps, there is disclosed a dispenser in National Publication of International Patent Application No. 2013-510051. The dispenser disclosed in this publication includes a body provided with an output port, and a sealing portion for the output port; the sealing portion and the body are adapted to be capable of being moved in such a way as to be capable of pivotably relative to each other between an open position at which the output port is closed and a closure position at which the output port is closed by the sealing portion; and the sealing portion and the body are adapted to be fixedly engaged with each other. The sealing portion includes a fixing member that, at the closure position, fixes the sealing portion and the body and releases the sealing portion and the body from a fixed state, and in order to release them from the fixing state, a force applied to the fixing member energizes the sealing portion toward the open position. Thus, preferably, the dispenser facilitates the application of dispensed materials to desired positions.

For the above publication, however, there have been problems: one problem in that a reservoir drops, the dropped reservoir hits against a stationary article, a fixing member 7 is pressed, and a content is leaked out due to unintended opening (erroneous operation); the other problem, a sanitary problem in that the fixing member 7 is opened by being pushed upwardly by fingers, and thus, the fingers sometimes come into contact with the tip of a drop nozzle 9.

SUMMARY OF INVENTION

Thus, the present invention intends to provide a one-touch openable cap that is attached to a bottle and enables an opening operation of a lid portion to be performed by a single hand, and that prevents any opening of the lid portion due to erroneous operation.

In order to solve the above problems, the present invention provides (1)

A one-touch openable cap comprising:

a base including coupling means (a coupler) coupled to a bottle, a ring connected to a portion of the coupling means and disposed with a space between the coupling means and the ring, the ring being configured to be deformed by press forces from left and right sides so as to allow a front edge of the ring to be frontwardly pushed out, and a latch portion disposed on the front edge of the ring; and a lid portion disposed in such a way as to be pivotable relative to the base and including a body configured to cover the nozzle when the lid portion is closed, a claw disposed on the body and configured to be latched to the latch portion when the lid portion is closed;

wherein, upon press of the ring from the left and right sides, the ring is deformed, the claw is released from the latch portion, the lid portion pivots, and the nozzle is uncovered.

(2)

The one-touch openable cap according to (1), further comprising a pressing mechanism that couples the coupling means to the front edge of the base to press down a vicinity of the latch portion so as not to cause the vicinity of the latch portion to be upwardly deformed, and that enables a deformation movement of the front edge.

(3)

The one-touch openable cap according to (1), wherein the pivoting of the lid portion is made by spring energization.

(4)

The one-touch openable cap according to (1), wherein a protrusion is disposed on a rear side of the base in a protruding manner, and wherein the lid portion pivots in such a way as to cross over the protrusion, and the lid portion is latched to the protrusion to allow an opened state of the lid portion to be kept.

(5)

The one-touch openable cap according to (1), wherein the bottle includes the nozzle from which a content inside the bottle is discharged, and the lid portion includes, inside the lid portion, a seal portion made of a cushion material and disposed with a space between the lid portion and the seal portion, and wherein, when the lid portion is closed, a tip of the nozzle comes into airtight contact with the seal portion.

(6)

A storage and discharge apparatus comprising:

the one-touch openable cap according to any one of (1) to (5); and a bottle configured to couple the one-touch openable cap to the bottle, wherein a content is filled inside the bottle.

(7)

The storage and discharge apparatus according to (6), wherein the content is a dental medicament.

Advantageous Effects of Invention

The present invention is configured in such a way as described above, and thus, firstly, enables an opening operation of the lid portion to be performed by a single hand, and further, enables the prevention of any opening of the lid portion due to erroneous operation. Further, by providing the pressing mechanism, the opening accuracy is increased. By allowing the lid portion to be rotated by spring energization, fingers do not come into contact with the nozzle, and thus, the nozzle can be kept sanitary.

By providing the intrusion on the base that keeps the lid portion in a pivotable state, and allowing the edge portion of the lid portion to cross over the intrusion by a rotation force at the time of the pivoting, even when the one-touch openable cap is used in an upside-down state, the opened state of the lid portion can be kept, and the dropping of the content is not blocked by the lid portion.

By providing the space between the lid portion and the seal portion made of a cushion material, the amount of contact between the tip of the nozzle and the seal portion can be made stable, the deformation and deterioration of the nozzle due to its crush can be prevented, and the airtightness inside the bottle can be kept.

BRIEF DESCRIPTION OF DRAWINGS

FIG. 6 is a diagram that describes an opening mechanism utilizing a press and a deformation in the one-touch openable cap according to the present invention, (A) being a plan view of the one-touch openable cap, illustrating a state at the time when a base is deformed by press forces (F1 and F2) from left and right sides, (B) being a plan view of the one-touch openable cap, illustrating the base before the deformation or at the time when the deformation has been recovered. When F1 and F2 are stressed to the ring 5B (stress portions 5C and 5C), the width of ring 5B is compressed (W>W') and shortened. The ring 5B is deformed so as to cause the length in long-length direction orthogonal to the width direction to be elongated (L<L'). The claw 6B is released from the latch portion 5D, and the lid portion 6 is uncovered.

FIG. 7 is a cross sectional view of the storage and discharge apparatus, illustrating a state at the time when a content falls in drops from the nozzle.

DESCRIPTION OF EMBODIMENT

Hereinafter, an embodiment of the present invention will be described in detail based on the accompanying drawings. The present invention, however, is not limited to the embodiment.

Example 1

As illustrated in FIGS. 1 to 6, a storage and discharge apparatus 1 according to the present invention includes a bottle 2, a cover 3, and a one-touch openable cap 4.

The bottle 2 includes: a body 2*a* configured to be filled with a content 2*b*, especially, a fluid material, for example, a medicament used in dentists (a dental adhesive agent); a coupling portion 2*c* that is located above the body 2*a* and includes, on its outside, a screw thread 2*d* configured to be screwed with the one-touch openable cap 4; and a nozzle 2*e* that is located on the upper side of the coupling portion and configured to discharge the content 2*b* or cause it fall in drops from a tip portion 2*f* thereof. The shape and row material of each of the body 2*a* and the nozzle 2*e* are appropriately selected in accordance with requirements and a discharge method for the content 2*b*. There is no limitation in the shape of the coupling portion 2*c*, provided that the coupling portion 2*c* is configured to be coupled to the one-touch openable cap 4.

The cover 3 incorporates, in its internal space, the bottle 2 in a stationary state. The cover 3 is made of a cushion material for buffering an impact, for example, a drop impact, on the bottle 2, and further, when the content 2*b* is a volatile material or the like, the cover 3 is made of a heat insulating material for blocking a heat conduction to the bottle 2 (the content 2*b*) when needed.

Figure 4:
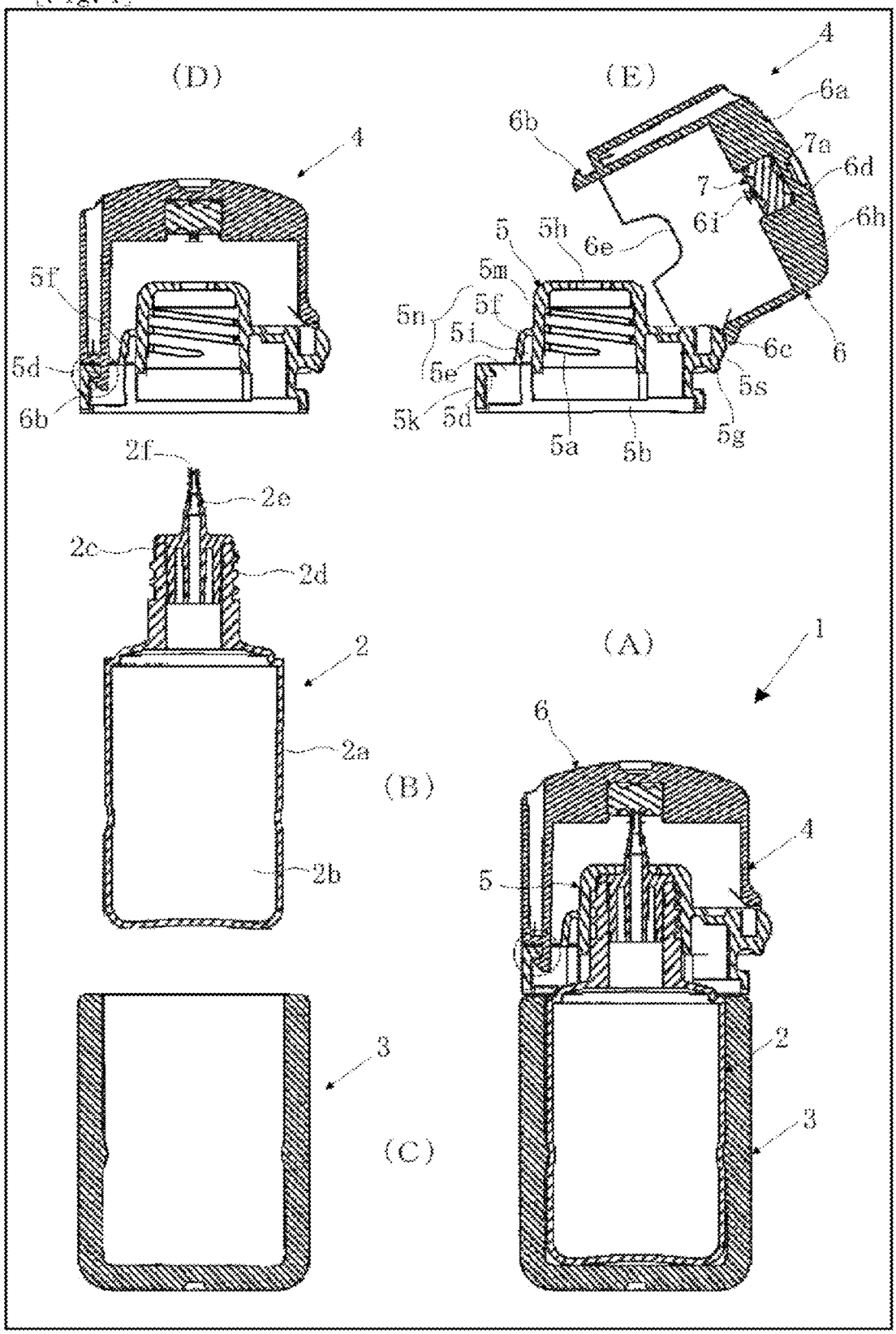
FIG. 4 is a segmented cross sectional view of the storage and discharge apparatus according to the present invention and illustrated in FIG. 2(F), (A) being the same diagram as that of FIG. 2(F), (B) being a cross sectional view of a bottle, (C) being a cross sectional view of a cover, (D) being a cross sectional view at the time when the one-touch openable cap is closed, (E) being a cross sectional view at the time when the one-touch openable cap is opened.

The one-touch openable cap 4 is formed of a base 5 and a lid portion 6, mainly as shown in FIG. 4 (E), and includes a seal portion 7 and a spring 8 (FIGS. 4 and 5) when needed. The one-touch openable cap 4 is attached to the bottle 2 to cover the nozzle 2*e*, and is capable of allowing an opening operation to be performed by a single hand.

The base 5 includes: a coupling means (a coupler) 5*m*, which has a cylindrical shape, and includes, on its inside, for example, a screw portion 5*a* configured to be coupled to the bottle 2; a ring 5*b*, which is connected to a portion of the coupling means 5*m*, is disposed with a space 5*r* between the coupling means 5*m* and the ring 5*b*, and is configured to be deformed so as to cause a front edge 5*k* to be frontwardly pushed out by press forces from left and right sides (for example, left and right simultaneous forces against left and right press portions 5*c* and 5*c*); and a latch portion 5*d*, which is disposed on the front edge of the ring 5*b*.

The coupling means 5*m* has, in its inside, a coupling portion 2*c* of the bottle 2 and the nozzle 2*e*, and the tip portion 2*f* of the nozzle 2*e* protrudes from a hole 5*h*. The latch portion 5*d* allows a claw 6*b* of the lid portion to be latched to the latch portion 5*d*.

Moreover, the base 5 includes a pressing mechanism that allows the coupling means 5*m* and the front edge 2*k* of the base 5 to be coupled to each other to press down the vicinity of the latch portion 5*d* so as not to cause the vicinity of the latch portion 5*d* to be upwardly deformed, and that enables a frontward deformation movement of the front edge 5*k* (FIG. 6(A)).

Figure 1:
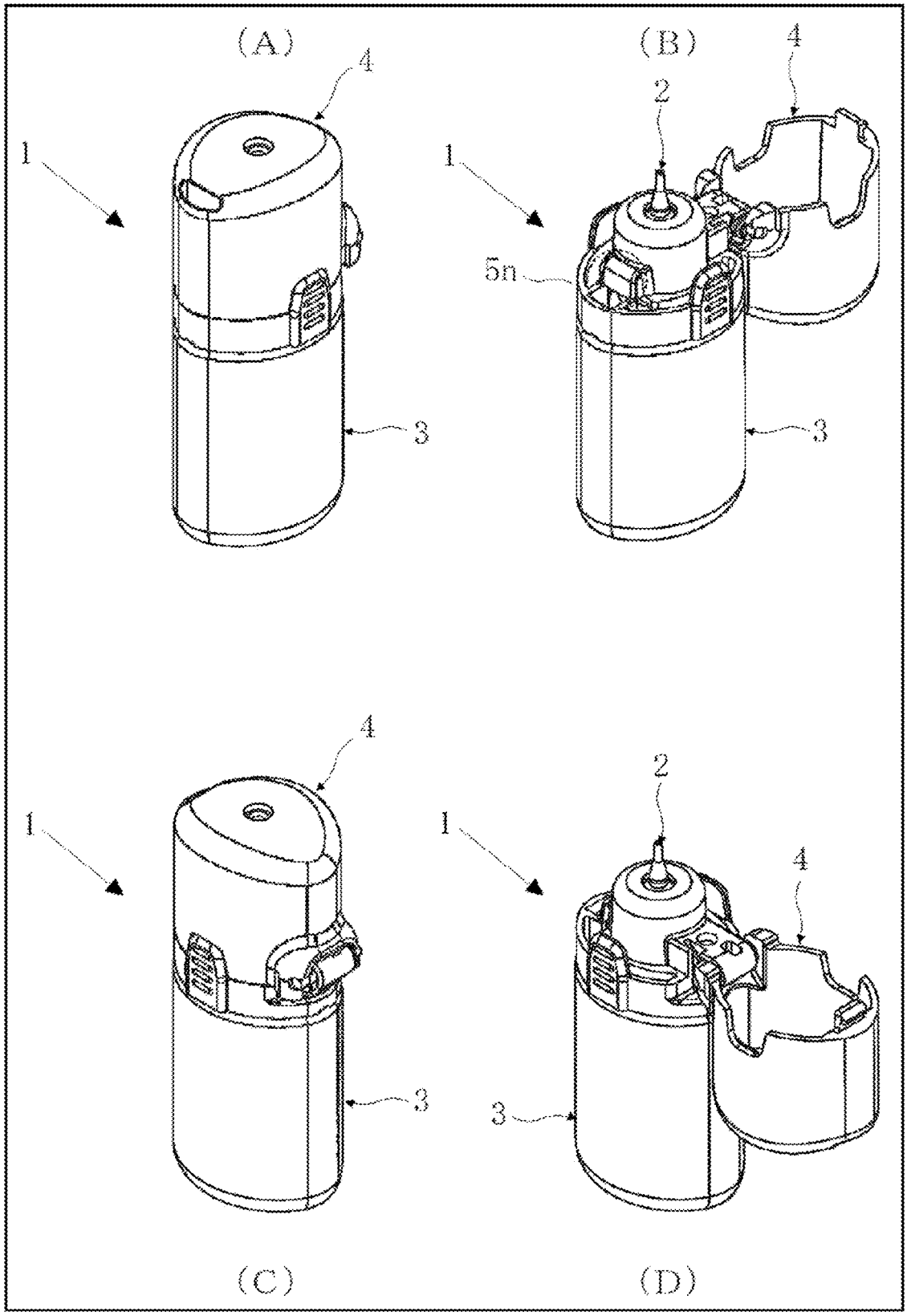
FIG. 1 is a diagram of a storage and discharge apparatus in which an example of a one-touch openable cap according to the present invention is attached to a bottle, (A) being a front side perspective view at the time when a lid portion is closed, (B) being a front side perspective view at the time when the lid portion is opened, (C) being a rear side perspective view at the time when the lid portion is closed, (D) being a rear side perspective view at the time when the lid portion is opened.
Figure 2:
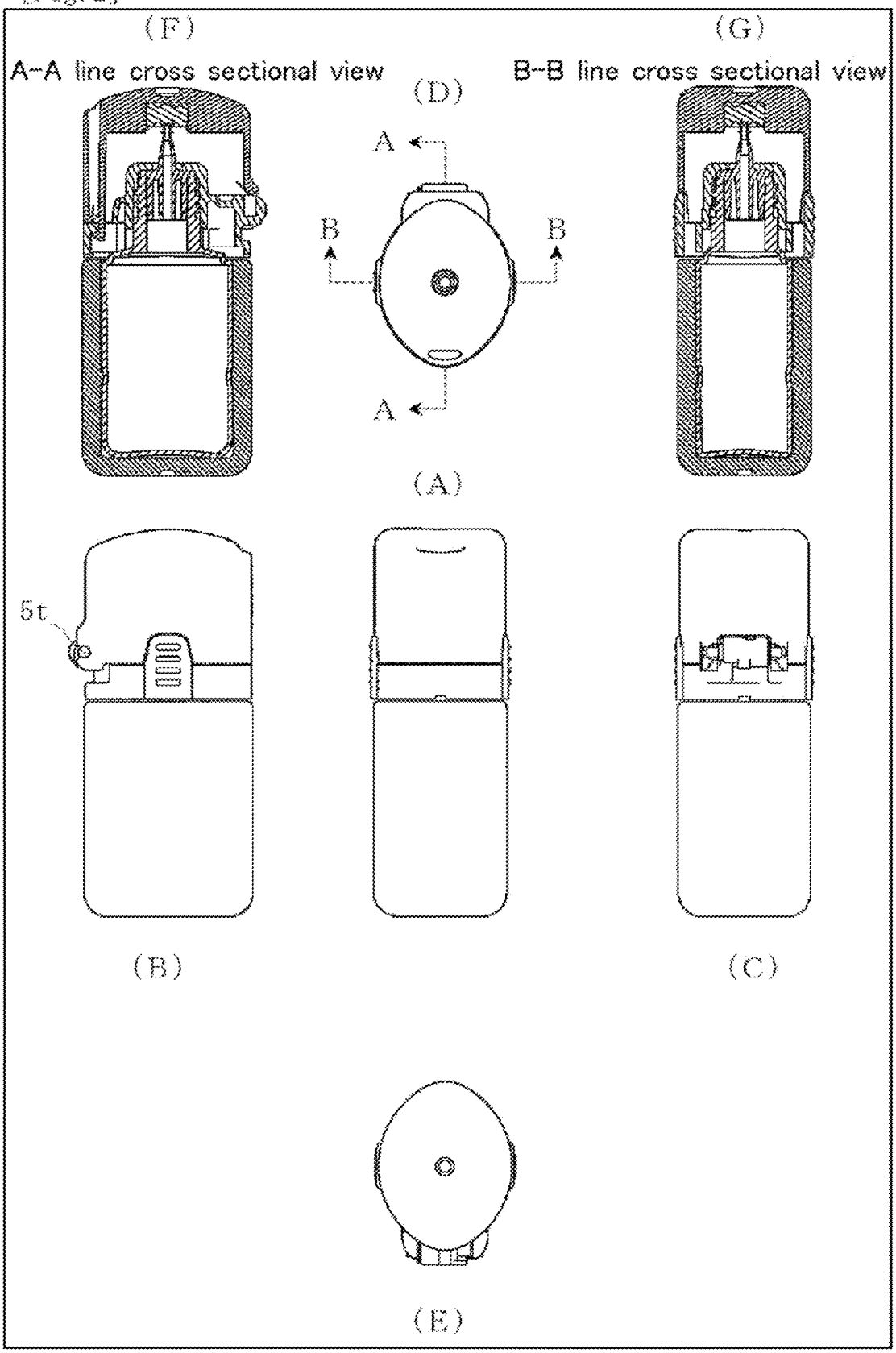
FIG. 2 is a diagram at the time when a one-touch openable cap of a storage and discharge apparatus according to the present invention is closed, (A) being a front view, (B) being a left side view, (C) being a rear side view, (D) being a plan view, (E) being a bottom view, (F) being a A-A line cross sectional view, (G) being a B-B line cross sectional view.
Figure 3:
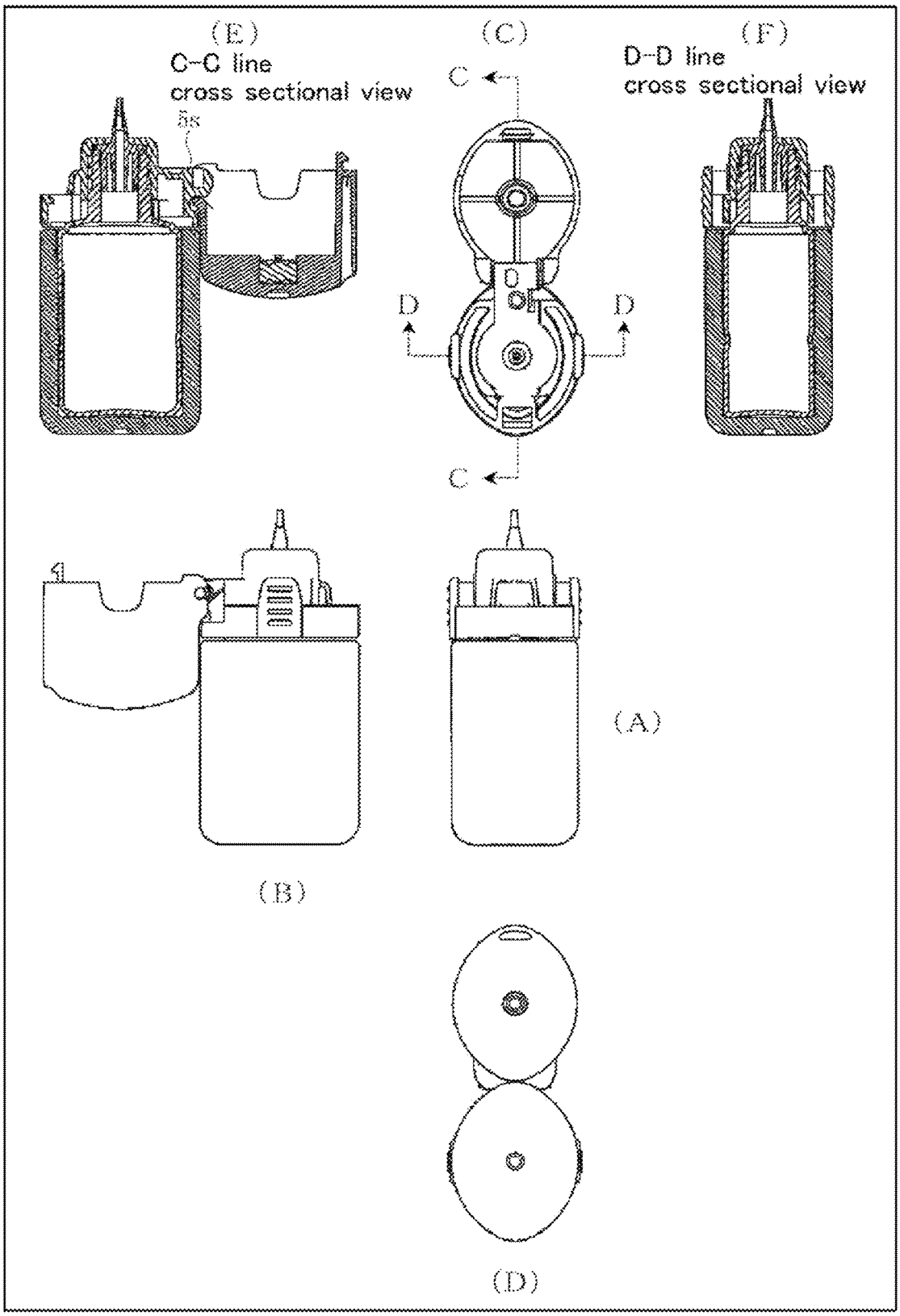
FIG. 3 is a diagram at the time when the one-touch openable cap of the storage and discharge apparatus according to the present invention is opened, (A) being a front view, (B) being a left side view, (C) being a plan view, (D) being a bottom view, (E) being a C-C line cross sectional view, (F) being a D-D line cross sectional view.

An example of the pressing mechanism 5*n* is shown in a dashed line enclosing portion of FIG. 1, or FIG. 4. In this example, the pressing mechanism 5*n* includes: a pressing member 5*f*, which has one end coupled to the outer circumference of the coupling means 5*m*, has an approximately L-letter shape in a vertical cross sectional view (FIG. 4(E)), and is disposed with a space 5*i* between the coupling means 5*m* and the pressing member 5*f*; and two frame plates 5*e* and 5*e*, which protrude from the front edge 5*k* of the ring 5*b*, and have upper faces to which the other end of the pressing member 5*f*, namely, the lower end thereof, is consecutively disposed.

The pressing mechanism 5*n* and the latch portion 5*d* form an opening 5*p* having a rectangular shape in a plan view; the claw 6*b* is inserted into the opening 5*p*; the claw 6*b* is latched to the latch portion 5*d*; thereby latching the lid portion 6 to the base 5 so as to keep the sealing of the nozzle 2*e*. In a dashed-line enclosing portion of FIG. 4, there is illustrated a state in which the latch portion 5*d* and the claw 6*b* are latched to each other.

Further, the base 5 includes: a receiving portion 5*s*, which is a portion where the lid portion 6 is pivotably attached at the side opposite the front edge 5*k*; and a left-to-right shaft 5*t* protruding from the receiving portion 5*s*. The lower edge of the lid portion 6 is fit into the left-to-right shaft 5*t*, and the lid portion 6 pivots about the shaft 5*t*.

Further, as an example method of keeping the opened state of the lid portion 6, a protrusion 5*g* is disposed on the receiving portion 5*s* in a protruding manner. A rotation force at the time of opening causes a fringe 6*c* of the lid portion 6 to cross over the protrusion 5*g*, and after the lid portion 6 has crossed over the protrusion 5*g*, even in an upside-down state for allowing the content 2*b* to drop (FIG. 7), the fringe 6*c* does not cross over the protrusion 5*g* because of the weight of the lid portion 6, thereby allowing the opened state of the lid portion 6 (the nozzle 2*e*) to be kept.

The lid portion 6 is disposed in such a way as to be pivotable relative to the base 5, and includes: a body 6*a*, which covers the nozzle 2*e* when the lid portion 6 is closed; and the claw 6*b*, which is disposed on the body 6*a*, and is latched to the latch portion 5*d* when the lid portion 6 is closed. Moreover, the body 6*a* disposes, in its inside, a rib 6*h* for a strength reinforcement, and the rib 6*h* is provided with a groove 6*d*, into which the seal portion 7 is incorporated. At four-direction portions of the groove 6*d*, claws 6*i* for preventing the drop of the seal portion 7 and latching to the seal portion 7 are disposed in a protruding manner. Further, in order to cause the left and right press portions 5*c* and 5*c* to protrude in directions toward the side faces, there are disposed cutouts 6*e* and 6*e* having shapes that come into close contact with the peripheries of the press portions 5*c* and 5*c*.

The seal portion 7 is preferred to be formed of a cushion material at a portion with which the tip portion 2*f* of the nozzle 2*e* comes into contact, thereby enabling the implementation of the protection and the stable sealed airtightness of the nozzle 2*e*. Moreover, when the seal portion 7 is disposed in such a way that a space 7*a* is disposed inside the body 6*a* of the lid portion 6 and between the body 6*a* and the seal portion 7, further stable sealed airtightness can be implemented.

Figure 5:
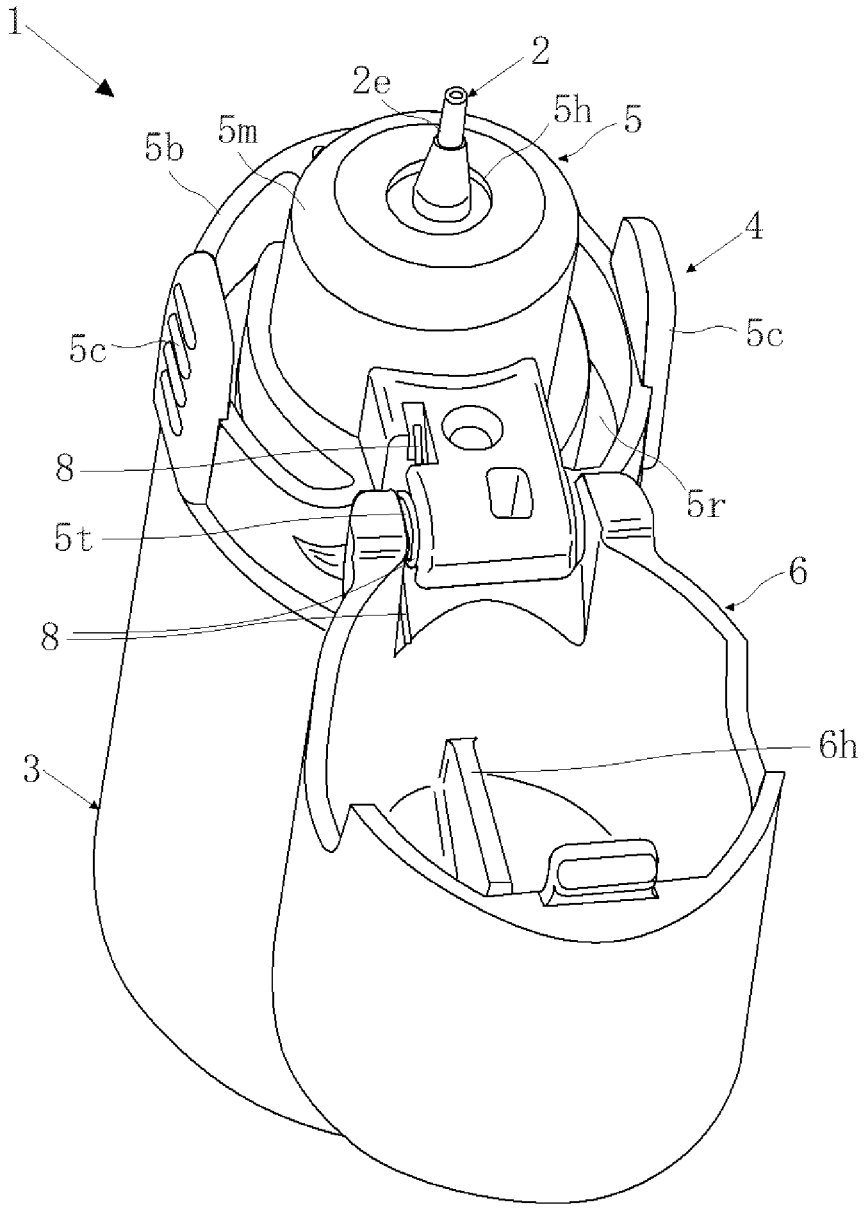
FIG. 5 is a rear side perspective view of the storage and discharge apparatus according to the present invention.

As illustrated in FIG. 5, the spring 8 is a torsion coil spring, which has a coil portion fit into the shafts 5*t*, has arms on the end portions latched to the base 5 and the lid portion 6, respectively, and exerts spring energization so as to cause the lid portion 6 to pivot in a direction for the nozzle 2*e* to be exposed. The spring 8 is not limited to torsion coil springs, and rather, any releasing mechanism may be employed that, upon release of the claw 6*b* from the latch portion 5*d*, allows the lid portion 6 to pivot in the direction for the nozzle 2*e* to be exposed.

With the one-touch openable cap 4 implemented as described above, as illustrated in FIG. 6(A), the ring is pressed from the left and right sides so that the ring 5*b* is deformed (deformed such that its left-to-right width W is compressed to W' and its long-length-direction length L is elongated to L'); the claw 6*b* is released from the latch portion 5*d*; the lid portion 6 is caused to pivot by the spring energization; the nozzle 2*e* is exposed and the lid portion 6 is uncovered.

The spring property of the ring 5*b* allows the lid portion 6 to be repeatedly opened and closed. The simultaneous pressing to the ring 5*b* from the left and right sides deforms the ring 5*b* so that the claw 6*b* is released from the latch portion 5*d*. Such configuration prevents any erroneous operation. For example, when a drop event occurs and only the press portion 5*c* at one side is pressed, spring at the other side absorbs a deformation pressure (buffer effect), and a deformation sufficient to allow the claw 6*b* to be released from the latch portion 5*d* does not occur, and thus, any erroneous pivoting of the lid portion 6 is prevented.

REFERENCE SIGNS LIST

1 storage and discharge apparatus
2 bottle
2*a* body
2*b* content
2*c* coupling portion
2*d* screw threads
2*e* nozzle
2*f* tip portion
3 cover
4 one-touch openable cap
5 base
5*a* screw portion
5*b* ring
5*c* press portion
5*d* latch portion
5*e* frame plate
5*f* pressing member
5*g* protrusion
5*h* hole
5*i* space
5*k* front edge
5*m* coupling means
5*n* pressing mechanism
5*p* opening
5*r* space
5*s* receiving portion
5*t* shaft
6 lid portion
6*a* body
6*b* claw
6*c* fringe
6*d* groove
6*e* cutoff
6*h* rib
6*i* claw
7 seal portion
7*a* space
8 spring

The invention claimed is:

1. A one-touch openable cap comprising:

a base comprising a coupler coupled to a bottle having a nozzle from which a content inside the bottle is discharged, a ring connected to a portion of the coupler and disposed with a space between the coupler and the ring, the ring being configured to be deformed by press forces from left and right sides so as to allow a front edge of the ring to be frontwardly pushed out, and a latch portion disposed on the front edge of the ring; and a lid portion disposed in such a way as to be pivotable relative to the base and comprising a body configured to cover the nozzle when the lid portion is closed, a claw disposed on the body and configured to be latched to the latch portion when the lid portion is closed;

wherein the one-touch openable cap is configured such that, upon press of the ring from the left and right sides, the ring is deformed, the claw is released from the latch portion, the lid portion pivots, and the nozzle is uncovered.

2. The one-touch openable cap according to claim 1, further comprising a pressing mechanism that couples the coupler to the front edge of the base to press down a vicinity of the latch portion so as not to cause the vicinity of the latch portion to be upwardly deformed, and that enables a deformation movement of the front edge.

3. The one-touch openable cap according to claim 1, wherein the pivoting of the lid portion is made by spring energization.

4. The one-touch openable cap according to claim 1, wherein a protrusion is disposed on a rear side of the base in a protruding manner, and wherein the lid portion pivots in such a way as to cross over the protrusion, and the lid portion is latched to the protrusion to allow an opened state of the lid portion to be kept.

5. The one-touch openable cap according to claim 1, wherein the lid portion includes, inside the lid portion, a seal portion disposed with a space between the lid portion and the seal portion, and wherein, when the lid portion is closed, a tip of the nozzle comes into airtight contact with the seal portion.

6. A storage and discharge apparatus comprising:

the one-touch openable cap according to claim 1; and a bottle configured to couple the one-touch openable cap to the bottle, wherein a content is filled inside the bottle.

7. The storage and discharge apparatus according to claim 6, wherein the content is a dental medicament.

* * * * *